US005584312A

United States Patent [19]

Van Becelaere

[11] Patent Number: 5,584,312

[45] Date of Patent: Dec. 17, 1996

[54] FIRE DAMPER FOR CEILING DIFFUSER

[75] Inventor: Robert M. Van Becelaere, Lake Lotawana, Mo.

[73] Assignee: Tomkins Industries, Inc., Dayton, Ohio

[21] Appl. No.: 343,702

[22] Filed: Nov. 21, 1994

[51] Int. Cl.[6] ..... F24F 13/06

[52] U.S. Cl. ..... 137/78.5; 454/257; 251/279

[58] Field of Search ..... 454/257, 298; 137/78.5; 251/129.11, 279

[56] References Cited

U.S. PATENT DOCUMENTS

| | | | |
|---|---|---|---|
| 3,346,013 | 10/1967 | Reichow . | |
| 3,580,321 | 4/1969 | Root . | |
| 3,606,245 | 6/1969 | Reichow . | |
| 3,677,517 | 7/1972 | Root . | |
| 3,718,081 | 2/1973 | Root . | |
| 3,738,254 | 6/1973 | Root . | |
| 3,817,485 | 6/1974 | Root . | |
| 3,996,952 | 12/1976 | Root . | |
| 4,366,830 | 1/1983 | Van Becelaere . | |
| 4,397,223 | 8/1983 | Maxson | 454/257 |
| 4,432,272 | 2/1984 | Van Becelaere . | |
| 4,559,867 | 12/1985 | Van Becelaere | 137/75 |
| 4,610,197 | 9/1986 | Van Becelaere | 98/1 |
| 4,800,804 | 1/1989 | Symington | 454/257 |
| 4,911,065 | 3/1990 | Van Becelaere | 137/75 |
| 5,238,220 | 8/1993 | Shell et al. | 454/257 |
| 5,310,021 | 5/1994 | Hightower | 454/257 |

FOREIGN PATENT DOCUMENTS

| | | |
|---|---|---|
| 1166928 | 5/1984 | Canada . |
| 1246961 | 12/1988 | Canada . |

*Primary Examiner*—Edward K. Look
*Assistant Examiner*—Michael S. Lee
*Attorney, Agent, or Firm*—Shook, Hardy & Bacon L.L.P.

[57] ABSTRACT

A protective damper for controlling the flow of fluid through a ceiling diffuser has a frame defining an opening through which the fluid flows. A barrier has a closed position which prevents the flow of fluid through the opening and an open position which allows fluid flow through the opening. The barrier is restricted to linear movement between the open and closed positions. A spring is operably coupled with a shaft and exerts a bias on the shaft tending to rotate the shaft on its longitudinal axis in one direction. An actuator is operably coupled with the shaft and rotates the shaft about its longitudinal axis in the opposite direction when the actuator is energized. An elongated rigid element is pivotally coupled with the shaft and with the barrier, respectively. The rigid element is for pulling the barrier by the shaft into the closed position when the shaft is rotated in the one direction and for pushing the barrier into the open position when the shaft is rotated by the actuator in the opposite direction.

11 Claims, 2 Drawing Sheets

Fig.1.
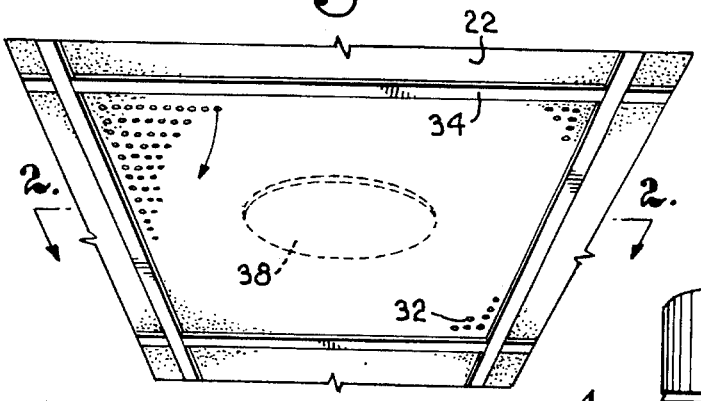
Fig.2.
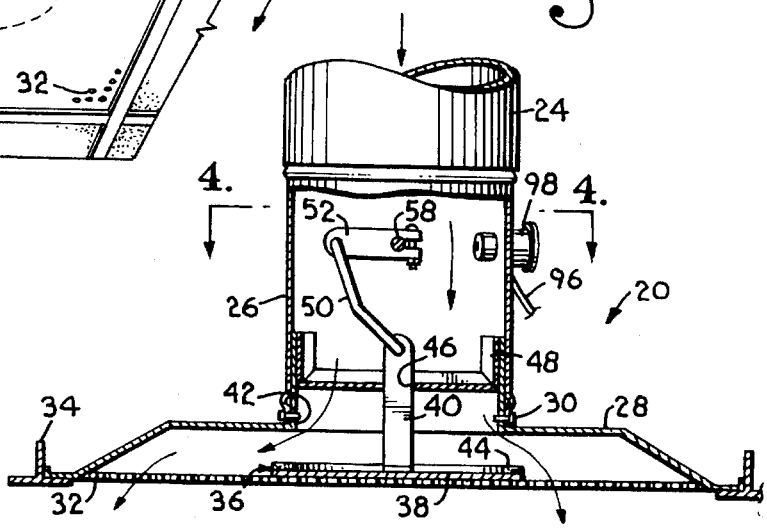
Fig.3.
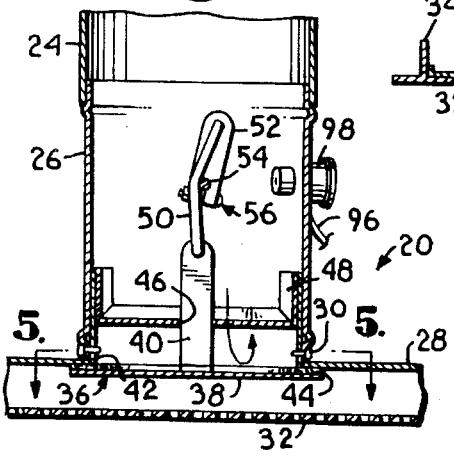
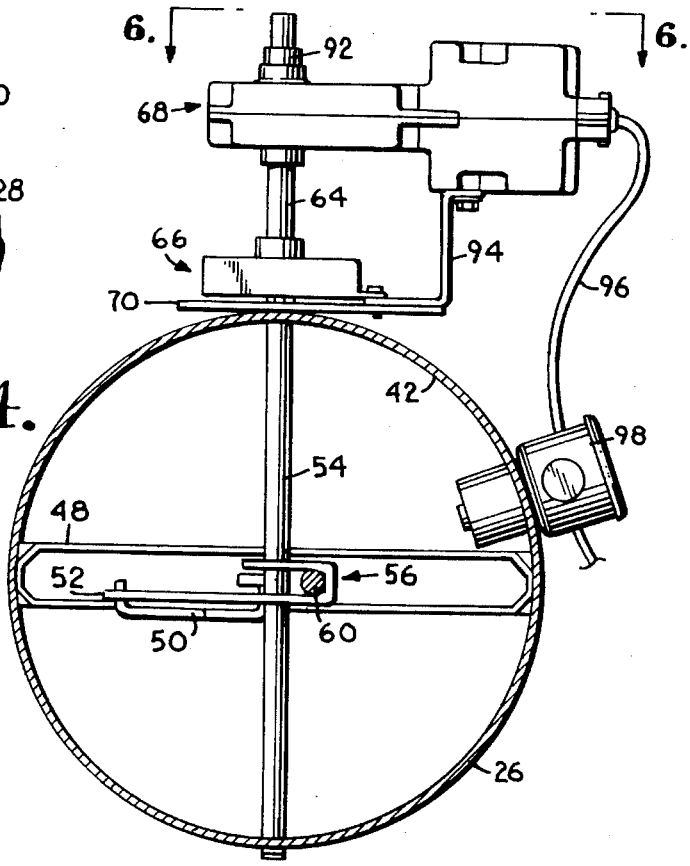
Fig.4.
Fig.11.
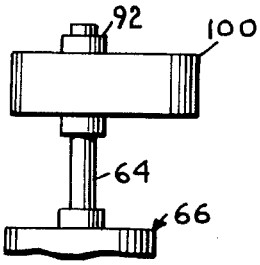

FIRE DAMPER FOR CEILING DIFFUSER

This invention pertains to ventilation control devices, and more particularly to a fire or smoke damper for use in protecting the ventilation conduits of a building.

Most buildings are subject to certain codes promulgated by appropriate governmental bodies which require that duct work and various communication channels in a building be protected with barriers which close off the duct or channel at strategic locations in case of fire. These barriers help to prevent the spread of the fire through the building and also serve to prevent distribution of toxic smoke and fumes throughout the building through the ventilation system.

Typically, fire and smoke dampers comprise frame mounted closures which may be interposed directly into the passages and conduits of the building. The closure is usually biased toward the flow blocking or closed position by one or more springs and is held in a standby or open position by an energized electric motor or actuator. De-energizing of the motor or actuator causes the damper to close automatically due to the biasing force of the spring or springs. A temperature or smoke responsive switch is associated with each damper to cause the actuator to become de-energized upon detection of an elevated temperature or smoke in the vicinity of the duct.

U.S. Pat. Nos. 4,911,065 and 4,432,272, which are incorporated herein by reference, disclose a damper which has a plurality of rectangular blades that are pivotally mounted in a frame. The blades are rotated between an open and a closed position. The blades are biased toward their closed position by a spring and are maintained in their open position by the energizing of an electric motor. If the motor is de-energized, the biasing force of the spring rotates the blades to their closed position. These patents also disclose electrical control systems for detecting smoke and fire in the vicinity of the damper and for selectively controlling the damper.

Although the dampers disclosed in these patents have proved to be commercially successful and provide an advantageous structure, they oftentimes have proved to be too bulky or heavy for use in overhead applications, for example, with a ceiling diffuser. The plurality of blades with their rotating motion and connecting linkage may make use of these dampers in an overhead application undesirable. Additionally, the dampers disclosed in these patents are often limited to rectangular-shaped ducts because of the rotational combined closing action of the plurality of blades. Thus, a simple, relatively lightweight damper for use in a ceiling diffuser or duct is needed. Such a damper preferably would accommodate a duct having any type of cross-sectional configuration.

Accordingly, it is a primary object of the present invention to provide an improved damper which can be used with a ceiling supply duct or diffuser because of its simple structure and relatively light weight.

It is a further object of the present invention to provide a damper which is linearly displaced from its open position to its closed position to prevent the need for having a plurality of rotatable blades to close a vent or duct.

It is a still further object of the present invention to provide a damper which can accommodate a variety of shapes and sizes of vents or ducts because of its simple and non-rotating closing structure.

These and other important aims and objects of the present invention will be further described or will become apparent from the following description and explanation of the drawings, wherein:

FIG. 1 is a bottom perspective view of a ceiling diffuser embodying the principles of this invention installed in a ceiling and showing a portion of the hidden structure of the damper in broken lines;

FIG. 2 is an enlarged, detailed cross-sectional view taken generally along line 2—2 of FIG. 1, and showing the damper in its open position;

FIG. 3 is a view similar to FIG. 2, but showing the damper in its closed position;

FIG. 4 is an enlarged, detailed cross-sectional view taken generally along line 4—4 of FIG. 2;

FIG. 11 is a view similar to FIG. 4 showing an alternative pneumatic actuator attached to the axle of the damper.

Figure 5:
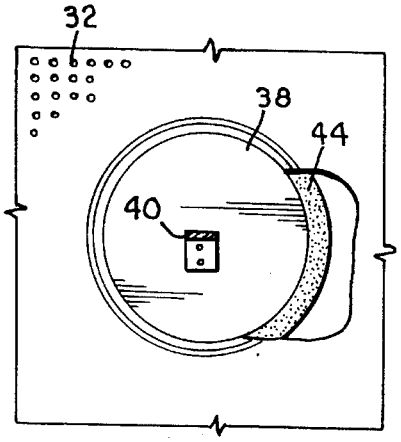
FIG. 5 is a detailed cross-sectional view taken generally along line 5—5 of FIG. 3, parts being broken away to reveal details of construction.
Figure 6:
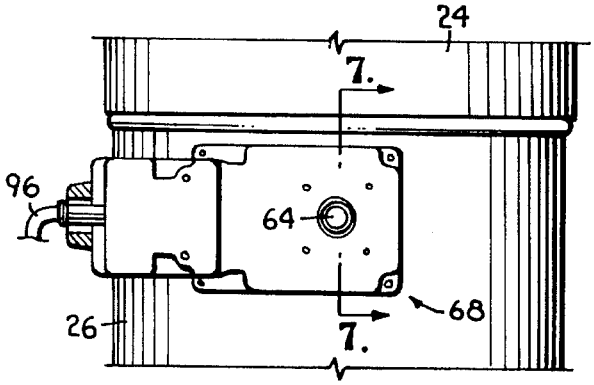
FIG. 6 is a side elevational view taken generally along line 6—6 of FIG. 4, and showing the electric actuator of the present invention.

A damper for a ceiling diffuser embodying the principles of this invention is broadly designated in the drawings by the reference numeral 20. Damper 20 is positioned in ceiling 22 and, when in its open position, allows air to flow from supply duct 24 through the damper and into a room or area of a building as indicated by the arrows in FIGS. 1 and 2.

Damper 20 has frame 26 which is connected to and in fluid communication with duct 24 on one end and is attached to diffuser hood 28 on the other end by, for example, bolts 30. Hood 28 has perforated diffuser screen 32 for dispersing air flowing therethrough. Damper 20 with hood 28 and screen 32 are disposed and supported in ceiling 22 by ceiling support members 34. Although frame 26 is depicted in the figures as having a circular-shaped cross section, it can have any desired cross-sectional shape, for example, a rectangular shape. Further, hood 28 does not have to be of rectangular shape as indicated in the figures, but can be of any other desirable shape.

Figure 7:
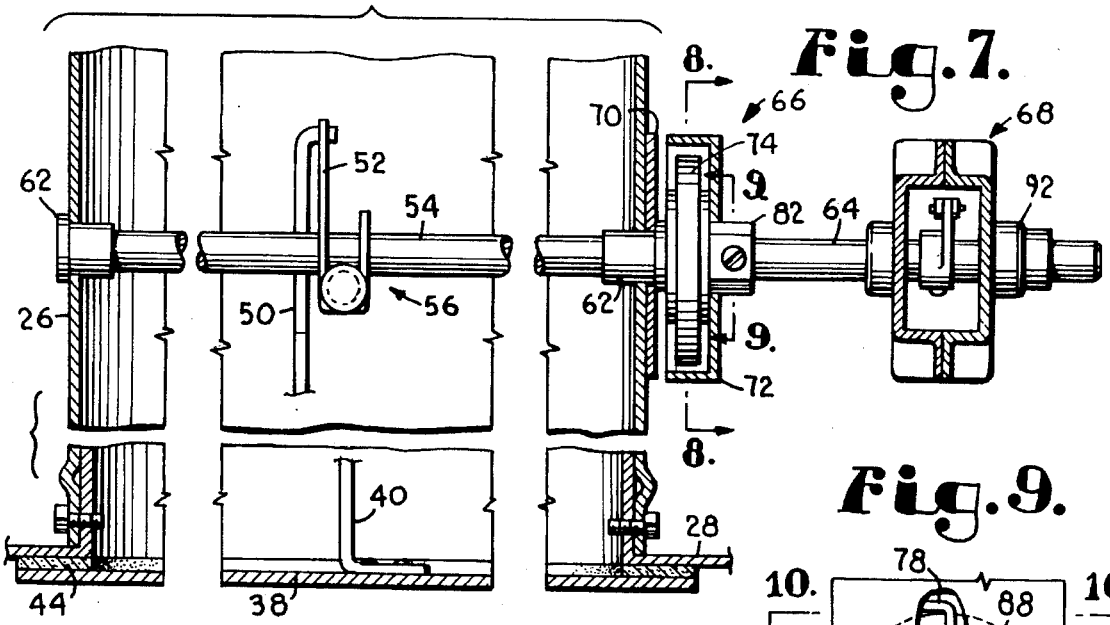
FIG. 7 is an enlarged, fragmentary detailed cross-sectional view taken generally along line 7—7 of FIG. 6, but showing the damper in its closed position.

Damper 20 has barrier assembly 36 which serves to block the flow of fluid or air through frame 26 when barrier 36 is in its closed position as indicated in FIGS. 3 and 7. Barrier 36 allows air to flow through frame 26 and be dispensed by hood 28 and screen 32 when it is in its open position as depicted in FIG. 2. As shown in FIG. 2 by the arrows, barrier 36 serves to disperse the air toward the peripheral portions of hood 28 to thus provide a more evenly dispersed flow pattern.

Barrier 36 has blade portion 38 and tab portion 40 perpendicularly attached to blade 38. Tab 40 can be attached to blade 38 by any suitable means, for example, rivets. Blade 38 serves to block and is seated over opening 42 in frame 26 when damper 20 is in its closed position. Although blade 38 is disclosed in the drawings as being circular in shape, it can be constructed of any desired shape to correspond to the shape of frame 26. Blade 38 has annular sealing member 44 disposed along its upper surface periphery, as best shown in FIGS. 2, 3, 5, and 7. Sealing member 44 serves to ensure an airtight seal to prevent flow into and out of the damper when it is in its closed position, as shown in FIG. 3. Member 44 is preferably made of a deformable material that will provide this sealing action, for example, a silicone sponge material.

Tab 40 is slidably received in slot 46 formed in guide 48, as best shown in FIGS. 2–4. Guide 48 extends across the interior of frame 26 and is attached to opposite sides thereof by any suitable means by, for example, rivets.

The upper end of tab 40 has an aperture therein which rotatably receives one end of elongated rigid connecting element or rod 50. The other end of rod 50 is rotatably connected to one end of elongated rigid actuating arm or crank arm 52. Rod 50 has a bend in it at an intermediate portion. This bend allows barrier 36 to be locked into its closed position, as will be more fully described below. Arm 52 has an aperture into which the upper end of rod 50 is received. Arm 52 is fixedly connected to axle or shaft 54 by pinch tightening structure 56. Structure 56 has aperture 58 which is positioned about axle 54 and which is tightened about axle 54 by tightening bolt 60.

Axle 54 is rotatably received by bearings 62 which are disposed in opposite sides of frame 26 as best shown in FIG. 7. Axle 54 has extended portion 64 which extends through one of bearings 62 and out one side of frame 26. Portion 64 is coupled to spring assembly 66 and electric actuator assembly 68 in a manner that will be more fully described below.

Figure 9:
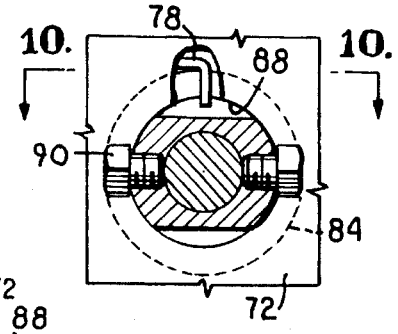
FIG. 9 is an enlarged, detailed cross-sectional view taken generally along line 9—9 of FIG. 7, parts being broken away to reveal details of construction.
Figure 8:
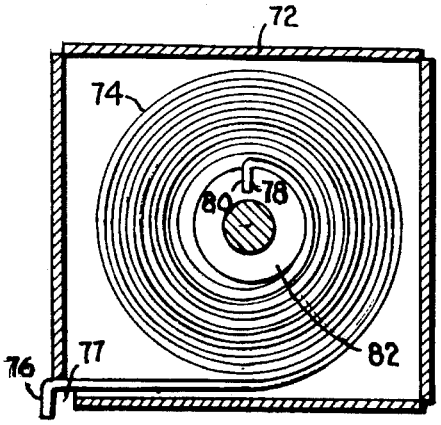
FIG. 8 is an enlarged, cross-sectional view taken generally along line 8—8 of FIG. 7, and showing the spring for biasing the damper to its closed position.
Figure 10:
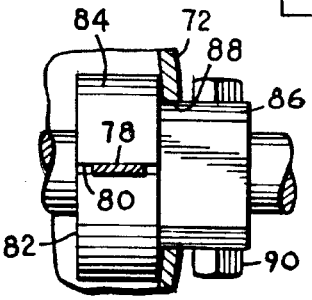
FIG. 10 is a detailed cross-sectional view taken generally along line 10—10 of FIG. 9.

Spring assembly 66 is connected to mounting plate 70 which is directly connected to one side of frame 26 as best shown in FIG. 4. Assembly 66 has spring retainer 72 which houses return spring 74 as best shown in FIG. 8. Outer end 76 of spring 74 is received in slot 77 of retainer 72. Inner end 78 of spring 74 is received in slot 80 of spring hub 82 as best shown in FIGS. 8–10. Hub 82 has enlarged diameter portion 84 and smaller diameter portion 86. Portion 84 is positioned on the inside of retainer 72 and portion 86 is received through aperture 88 in retainer 72. Portion 84 is positioned in the interior of spring 74 so that end 78 can be received in slot 80. Hub 82 is fixedly secured to axle portion 64 by set screws 90 which are threadably received in portion 86 as best shown in FIG. 9.

Spring 72 is initially biased or coiled when positioned in retainer 72 with end 76 in slot 77 and end 78 in slot 80. Spring 74 is coupled to axle 54 so that the rotation of axle 54 that results when barrier 36 is in its open position, as shown in FIG. 2, results in further coiling or biasing of spring 72. Therefore, when barrier 36 is in its open position, the rotational biasing force applied to axle 54 tends to move barrier 36 to its closed position. This biasing force is applied by the initial and the further biasing of spring 74. The rotational biasing force applied to axle 54 is converted to the linear closing biasing force on barrier 36 via arm 52, rod 50, guide 48, and tab 40.

Axle portion 64 is further coupled to an actuator 68. Actuator 68 can be a solenoid or an electric motor with associated brake or clutch components. An actuator manufactured under the Model No. MA220 by Barber Colman of Rockford, Ill., has been found to work adequately. Actuator 68 is affixed to axle portion 64 via attaching hub 92. Hub 92 can be affixed to portion 64 by any suitable means, for example, set screws, or a groove and tongue type arrangement between hub 92 and portion 64. Actuator 68 is held in position by mounting plate 94 which is attached on one end to actuator 68 and on the other end to plate 70. Energizing of actuator 68 causes axle 54 to rotate so that barrier 36 is moved downwardly to its open position to allow air to flow through frame 26 and out screen 32. The rotational force applied to axle 54 by actuator 68 is converted to the opening linear force applied to barrier 36 via arm 52, rod 50, guide 48, and tab 40.

Actuator 68 is supplied electrical power through wire 96. Wire 96 is also electrically coupled to switch 98 which is positioned such that a portion thereof is within frame 26. Switch 98 can be of a thermal responsive type so that if the temperature within frame 26 reaches a predetermined level, it will disconnect electrical power to actuator 68, thus, causing barrier 36 to move upwardly to its closed position because of the biasing force of spring 74. Switch 98 can also be of a variety that senses smoke within frame 26 and in response thereto disconnect power to actuator 68, thus, also causing barrier 36 to obtain its closed position. Actuator 68 can also be externally controlled to open and closed damper 20 by applying the appropriate control signals to wire 96.

In operation, actuator 68 is energized by wire 96 so that barrier 36 is moved downwardly via arm 52, rod 50, guide 48, and tab 40. This position is the open position of the damper and is its normal stand-by position. In this position, conditioned air is free to flow into the area of the building in which the damper is located. If the temperature within the particular area where the damper is located rises to a sufficient level or, if switch 98 is of the smoke sensing type, if smoke is present in the area, switch 98 senses the particular predetermined condition and disconnects or de-energizes actuator 68. As this is done, the biasing force applied to barrier 36 by spring 74 causes barrier 36 to move to its closed position as shown in FIG. 3. In this closed position air within the area in which the damper is located is not allowed to enter duct 24, nor is conditioned air from duct 24 allowed to enter the area. Barrier 36 is locked or secured in this closed position because of the over center position of arm 52 and the engagement of the bend in rod 50 with axle 54, as shown in FIG. 3. More particularly, the over center position of arm 52 is when it is rotated beyond an imaginary line or axis which is an extension of the linear path of travel of tab 40, that is, an extension of the vertical axis of tab 40. The bend in rod 50 allows arm 52 to reach this over center position when barrier 36 is biased to its closed position. In this closed locked position, force applied to the top surface of barrier 36, such as by forced air, smoke, water, or other means will not be able to move barrier 36 downwardly. However, energizing of actuator 68 will rotate arm 52 out of its locked position so that the actuator can move barrier 36 downwardly to its open position against the bias of spring 74.

Although an electric actuator is described in the above embodiment, a pneumatic or other suitable type of actuator 100 will also work for rotating axle 54 to move barrier 36 to its downward open position as shown in FIG 11. In a pneumatic system, compressed air or vacuum is supplied to energize the actuator and open the damper. The pneumatic system can also be coupled to an electric switch which can be configured to sense an elevated temperature or smoke. In response to sensing these conditions, the switch operates a valve to interrupt the flow of compressed air or vacuum to the actuator, thus allowing the damper to close.

The damper of the present invention provides a simple economical structure for use in ceiling diffusers that incorporates the damper itself within the diffuser. The damper uses the simple linear displacement of a single blade rather than rotation of a plurality of blades through a relatively complicated linkage. Further, the damper can be used with a variety of different shaped air supply ducts and diffusers.

Having described the invention, what is claimed is:

1. A protective damper for controlling the flow of fluid through a ceiling diffuser, the damper comprising:

a frame defining an opening through which the fluid flows;

a barrier having a closed position which prevents the flow of fluid through said opening and an open position which allows the fluid flow through said opening;

means operably coupled with the frame and with the barrier respectively for restricting the barrier to linear movement between said open and closed positions;

an elongated shaft;

spring means operably coupled with said shaft and exerting a bias on said shaft tending to rotate said shaft on its longitudinal axis in one direction;

an actuator operably coupled with said shaft for rotating said shaft about its longitudinal axis in the opposite direction when the actuator is energized; and an elongated, rigid element pivotally coupled with the shaft and with said barrier respectively for pulling said barrier by said shaft into said closed position when the shaft is rotated in said one direction, and for pushing the barrier into said open position when said shaft is rotated by the actuator in said opposite direction.

2. The damper of claim 1 wherein said barrier includes a planar blade for blocking said opening when said barrier is in said closed position and a tab extending perpendicularly to said blade and operably coupled to said rigid element.

3. The damper of claim 2 wherein said shaft is carried by the frame and extends transversely across the opening.

4. The damper of claim 2 wherein said shaft is provided with an elongated rigid crank arm rigidly secured to said shaft and extending radially therefrom for rotation therewith, the pivotal coupling of said elongated element with said shaft being through said arm with said elongated element being pivotally connected to said arm at a location spaced radially outwardly from said shaft whereby rotation of said shaft swings said arm on a rotary path of travel to move said location toward or away from said opening of said frame to pull or push said arm.

5. The damper of claim 4 wherein said rotary path of travel of said arm has a first point that is directly above said tab, and wherein said arm is rotated by said shaft to a second point along said rotary path that is beyond said first point when said barrier is in its closed position.

6. The damper of claim 4 wherein said blade has a seat in a closed position, said blade being moved toward or away from the seat by rotation of said crank arm.

7. The damper of claim 1 wherein said actuator is electrically operated.

8. The damper of claim 1 wherein said actuator is pneumatically operated.

9. A protective damper for controlling the flow of fluid through a ceiling diffuser, the damper comprising:

a frame defining an opening through which the fluid flows;

a barrier carried by said frame and having a closed position which prevents the flow of fluid through said opening and an open position which allows the flow of fluid through said opening, said barrier being linearly displaced between its first and second positions;

an axle rotatably supported by said frame;

a spring operably coupled with said axle so that said spring exerts a rotational biasing force on said axle;

an actuator coupled to said axle and adapted to be coupled with a source of power so that said actuator exerts a rotational force on said axle in a direction opposite to said biasing force when said actuator is energized;

a rigid actuating arm attached to the periphery of said axle;

a rigid connecting rod pivotally coupled at one of its ends to said actuating arm and coupled at its other end to said barrier; and wherein said rotational biasing force is converted to a linear biasing force via said actuating arm and said connecting rod so that said barrier is biased into its closed position, and wherein said rotational force exerted by energizing said actuator is converted to a linear force via said actuating arm and said connecting rod to move said barrier to its open position.

10. The damper of claim 9 wherein said actuator is electrically operated.

11. The damper of claim 9 wherein said actuator is pneumatically operated.

* * * * *